US005293746A

United States Patent [19]

Bianchetta

[11] Patent Number: 5,293,746

[45] Date of Patent: Mar. 15, 1994

[54] HYDRAULIC CONTROL SYSTEM

[75] Inventor: Donald L. Bianchetta, Coal City, Ill.

[73] Assignee: Caterpillar Inc., Peoria, Ill.

[21] Appl. No.: 997,428

[22] Filed: Dec. 28, 1992

[51] Int. Cl.[5] ..... F16D 1/02

[52] U.S. Cl. ..... 60/435; 60/444; 91/536

[58] Field of Search ..... 60/435, 444, 429; 91/536

[56] References Cited

U.S. PATENT DOCUMENTS

| | | | |
|---|---|---|---|
| 3,972,185 | 8/1976 | Medina | 60/421 |
| 3,986,357 | 10/1976 | Hoffmann | 60/444 |
| 4,481,769 | 11/1984 | Nagahara | 60/442 |
| 4,712,377 | 12/1987 | Yoshida et al. | 60/444 |

*Primary Examiner*—Edward K. Look

*Assistant Examiner*—F. Daniel Lopez

*Attorney, Agent, or Firm*—John W. Grant

[57] ABSTRACT

A hydraulic control system has first and second actuators that can be selectively moved to a second operating position dependant upon the pressure of hydraulic fluid being simultaneously transmitted thereto through a common conduit. The force of the springs of the first and second actuators is selected so that when the pressure of the hydraulic fluid is at a preselected low pressure, only one of the actuators is moved to its second position and both of the actuators is moved to their second positions when the fluid is at a preselected high pressure. The use of a common conduit for carrying fluid to the actuators eliminates the expense and complexity of providing another flow path between rotatable parts of a vehicle.

6 Claims, 1 Drawing Sheet

HYDRAULIC CONTROL SYSTEM

DESCRIPTION

1. Technical Field

This invention relates generally to a hydraulic control system and more particularly to directing two separate hydraulic signals through a common conduit.

2. Background Art

The hydraulic system of a hydraulic excavator or the like includes a swivel disposed between the undercarriage and the upper structure rotatably mounted on the undercarriage. The swivel commonly has several fluid flow paths therethrough including both implement fluid flow paths and pilot fluid flow paths. The exact number of flow paths depends upon the number of hydraulically actuated components mounted on the undercarriage. The swivel is normally designed to have only the exact number of flow paths needed since any additional flow path would add cost and complexity thereto. Occasionally, however, after the vehicle has been designed and built, an additional operating function is added to the vehicle thereby requiring transmitting an additional fluid signal between the upper structure and the undercarriage. This creates a problem of how to effectively transmit the added fluid signal between the rotatable upper structure and the undercarriage to achieve the added operational function in the most economical manner.

Thus, under the above conditions, it would be desirable to be able to utilize an existing flow path through the swivel for two separate hydraulic functions. This would eliminate the expense of designing a new swivel as well as permitting the continual use of an existing less expensive swivel.

The present invention is directed to overcoming one or more of the problems as set forth above.

DISCLOSURE OF THE INVENTION

In one aspect of the present invention, a hydraulic control system has a first fluid actuator movable from a first position to a second position when the pressure of fluid directed thereto is at or exceeds a preselected low pressure. A second fluid actuator is movable from a first position to a second position only when the pressure of fluid directed thereto reaches a preselected high pressure that is higher than the preselected low pressure. A common fluid conduit is connected to both the first and second actuators. A first means selectively directs fluid at the preselected low pressure through the conduit so that only the first fluid actuator is moved to its second position. A second means selectively directs fluid at the preselected high pressure through the conduit so that both the first and second actuators are moved to their second positions.

BRIEF DESCRIPTION OF THE DRAWINGS

The sole figure is a schematic illustration of an embodiment of the present invention.

BEST MODE FOR CARRYING OUT THE INVENTION

Figure 1:
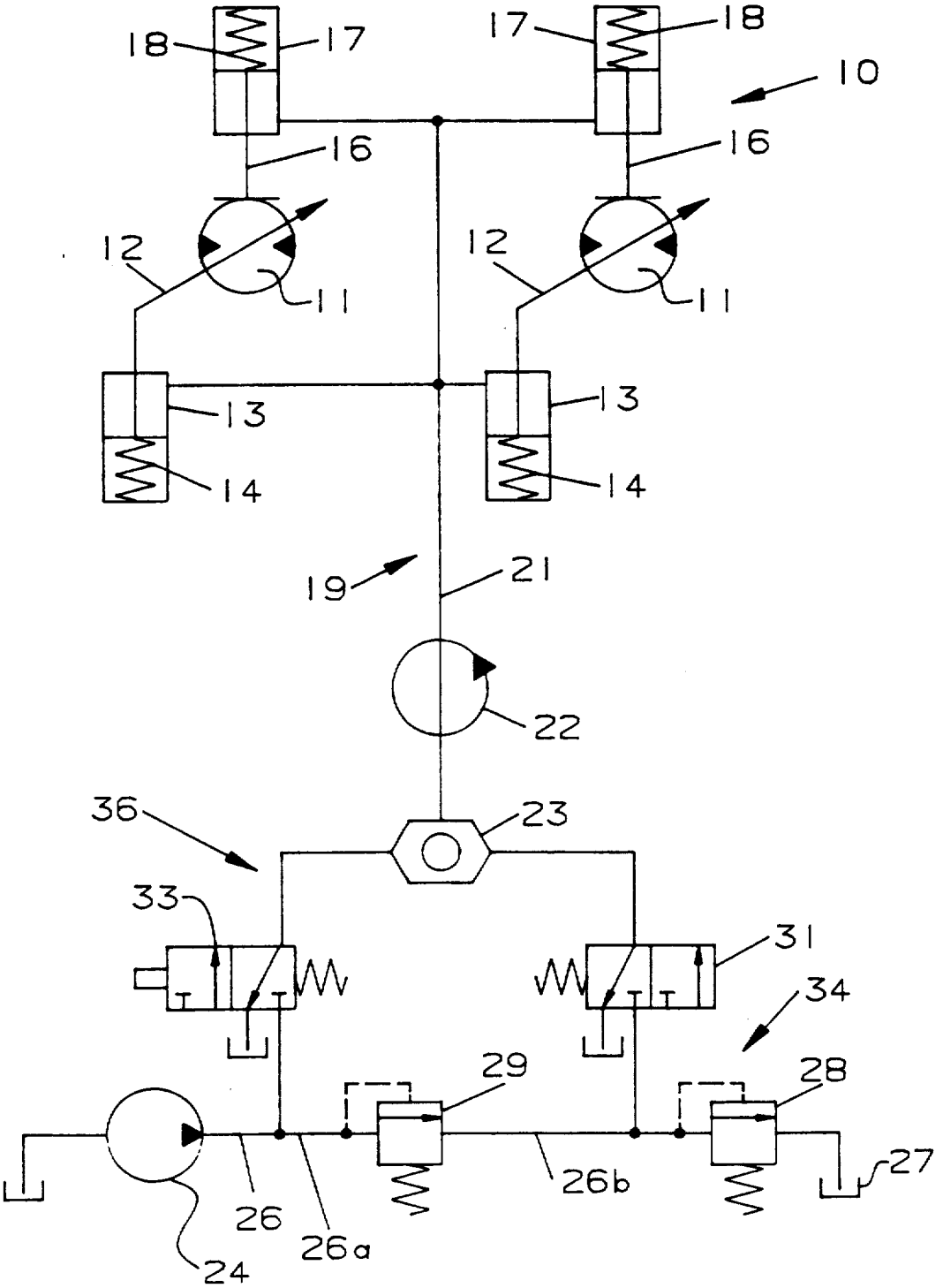

A hydraulic control system 10 includes a pair of two speed hydraulic motors 11 each having a fluid displacement control member 12 which determines whether the motor runs at slow or high speed. A pair of fluid actuators 13 are connected to the displacement control members 12 with each actuator having a coil compression spring 14 resiliently urging the displacement control member 12 to the maximum displacement, slow speed position shown. A pair of brakes 16 are operatively associated with the hydraulic motors 11. Each of the brakes 16 has a fluid actuator 17 resiliently biased to a "brake on" position by a coil compression spring 18. The force of the springs 18 is selected s that the fluid actuators 17 are moved from the "brake on" position shown to a "brake off" position when the pressure of fluid directed thereto is at or exceeds a preselected low pressure. The force of the springs 14 is selected so that the actuators 13 and hence the members 12 are moved from the slow motor speed position to a fast motor speed position when the pressure of fluid directed thereto reaches a preselected high pressure that is higher than the preselected low pressure.

A conduit means 19 is connected to the fluid actuators 13 and 17 and includes a common conduit 21 passing through a swivel 22 and connected to a resolver 23. A pilot pump 24 has its output connected to a pilot supply line 26 connected to a tank 27 through a pair of relief valves 28,29. The relief valve 28 has a pressure setting equal to the preselected low pressure while the relief valve 29 has a pressure setting equal to the preselected high pressure. Thus, the relief valve 29 will maintain the pressure of the fluid in a portion **26*a* of the pilot line 26 between the pilot pump 24 and the relief valve 29 at the preselected high pressure. Similarly, the relief valve 28 will maintain the fluid in a portion 26*b* of the pilot line 26 between the relief valves at the preselected low pressure. A two position control valve 31 is connected to the portion 26*b* of the pilot line 26 and to the resolver 23. A two position control valve 33 is connected to the portion 26*a* of the pilot line 26 and to the resolver 23**.

The control valve 31 and the resolver 23 make up a means 34 for selectively directing fluid at the preselected low pressure through the conduit 21 and conduit means 19 so that only the actuators 17 are moved to their second position. The control valve 33 and the resolver 23 constitute a second means 36 for selectively directing fluid at the preselected high pressure through the conduit 21 and the conduit means 19 so that both pairs of the actuators 13 and 17 are moved to their second positions.

INDUSTRIAL APPLICABILITY

In operation with both of the pilot control valves 31,33 in the position shown, the fluid pressure in the conduit 21 and thus the actuators 13 and 14 is at zero so that the brakes 16 are on and the displacement control members 12 are in their maximum displacement position at which the motors would run at a slow speed. Moving the control valve 31 leftwardly directs pilot fluid at the preselected low pressure through the conduit 21 and conduit means 19 to both pairs of the actuators 13 and 17. At the preselected low pressure, only the actuators 17 are moved to their "brake off" positions thereby releasing the brakes 16. The displacement control members 12 remain in their slow speed position so that the motors 11 can be driven at their slow speed in the conventional manner.

To move the actuators 12 to the high motor speed position, the control valve 33 is moved to its second position to direct pressurized fluid at the preselected high pressure through the conduit 21 to both pairs of actuators 13 and 17. With the fluid at the higher pressure, both pairs of actuators 13 and 17 are moved to their second positions whereby the brakes 16 are released and the displacement control member 12 is moved to its high speed position.

In view of the above, it is readily apparent that the structure of the present invention provides an improved hydraulic control system in which first and second pairs of fluid actuators connected to a common conduit selectively move to a second operating position dependent upon the pressure of the fluid being simultaneously transmitted to both pairs of actuators through the conduit. The spring force of each pair of actuators is selected so that when the pressure of the fluid is at the preselected low pressure only one pair of actuators is moved to their second positions and both pair of actuators are moved to their second positions when the fluid is at the preselected high pressure.

Other aspects, objects and advantages of this invention can be obtained from a study of the drawings, the disclosure and the appended claims.

I claim:

1. A hydraulic control system comprising:

a first fluid actuator movable from a first position to a second position when the pressure of fluid directed thereto is at or exceeds a preselected low pressure;

a second fluid actuator movable from a first position to a second position only when the pressure of the fluid directed thereto reaches a preselected high pressure that is higher than the preselected low pressure;

a common fluid conduit connected to both the first and second actuators;

first means for selectively directing fluid at the preselected low pressure through the conduit so that only the first actuator is moved to its second position; and second means for selectively directing fluid at the preselected high pressure through the conduit so that both the first and second actuators are moved to their second positions.

2. The hydraulic control system of claim 1 wherein the first means includes a first source of pressurized fluid at the preselected low pressure and a two position control valve connected to the conduit and the first source of fluid, and the second means includes a second source of pressurized fluid at the preselected high pressure and another control valve connected to the conduit and to the second source of pressurized fluid.

3. The hydraulic control system of claim 2 including a resolver connected between the conduit and the first and second control valves.

4. The hydraulic control system of claim 3 including a pilot pump and a pilot line connected to the pump output, the first source of pressurized fluid including a first relief valve disposed in the pilot line and the second source of pressurized fluid includes a second relief valve disposed in the pilot line between the pump and the first relief valve, the first relief valve having a pressure setting equal to the preselected low pressure and the second relief valve having a pressure setting equal to the preselected high pressure.

5. The hydraulic control system of claim 4 wherein the first control valve is connected to the pilot line between the relief valves and the second control valve is connected to the pilot line between the pump and the first relief valve.

6. The hydraulic control system of claim including a hydraulic motor having a displacement control member and a brake operatively associated with the motor and being movable between "brake on" and "brake off" positions, the first actuator being connected to the brake and the second actuator being connected to the displacement control member.

* * * * *